US005109614A

United States Patent [19]

Curry

[11] Patent Number: 5,109,614

[45] Date of Patent: May 5, 1992

[54] CONVERTIBLE ATHLETIC SHOE HAVING LOW TOP AND HIGH TOP CONFIGURATIONS

[76] Inventor: Eddie G. Curry, 3515 S. Cottage Grove - Apt. 1013, Chicago, Ill. 60653

[21] Appl. No.: 606,531

[22] Filed: Oct. 31, 1990

[51] Int. Cl.[5] ..... A43B 3/24

[52] U.S. Cl. ..... 36/100; 2/DIG. 6; 36/136

[58] Field of Search ..... 36/100, 99, 101, 45, 36/50

[56] References Cited

U.S. PATENT DOCUMENTS

| | | | |
|---|---|---|---|
| D. 280,57 | 9/1985 | Ji | 36/100 X |
| 854,274 | 5/1907 | Crook et al. . | |
| 2,200,080 | 5/1940 | Fein | 36/2.5 |
| 2,552,943 | 5/1951 | Danielius | 36/15 |
| 3,327,410 | 6/1967 | Park, Sr. et al. | 36/2.5 |
| 3,822,489 | 7/1974 | Johnson | 36/100 |
| 4,103,440 | 8/1978 | Lawrence | 36/100 |
| 4,333,248 | 6/1982 | Samuels | 36/101 X |
| 4,370,818 | 2/1983 | Simoglou | 36/100 |
| 4,745,693 | 5/1988 | Brown | 36/101 |
| 4,958,447 | 9/1990 | DuPree | 36/114 X |

*Primary Examiner*—David T. Fidei
*Assistant Examiner*—BethAnne C. Cicconi
*Attorney, Agent, or Firm*—Marshall O'Toole

[57] ABSTRACT

A convertible shoe having a low-top and a high-top configuration is provided which is comprised of a lower shoe portion with a foot opening, an upper adapter portion having a leg opening and a lower shoe opening and a first fastener portion disposed on the lower shoe portion partially surrounding the foot opening thereof. A second fastener portion is disposed on the upper shoe portion partially surrounding the lower shoe opening thereof which engages the first fastener portion to secure the upper adapter portion to the lower shoe portion to place the shoe in the high-top configuration. A foldable strip is carried by the lower shoe portion for concealing the first fastener portion when the upper adapter portion is not secured to the lower shoe portion during use in the low-top configuration.

18 Claims, 2 Drawing Sheets

FIG. 1
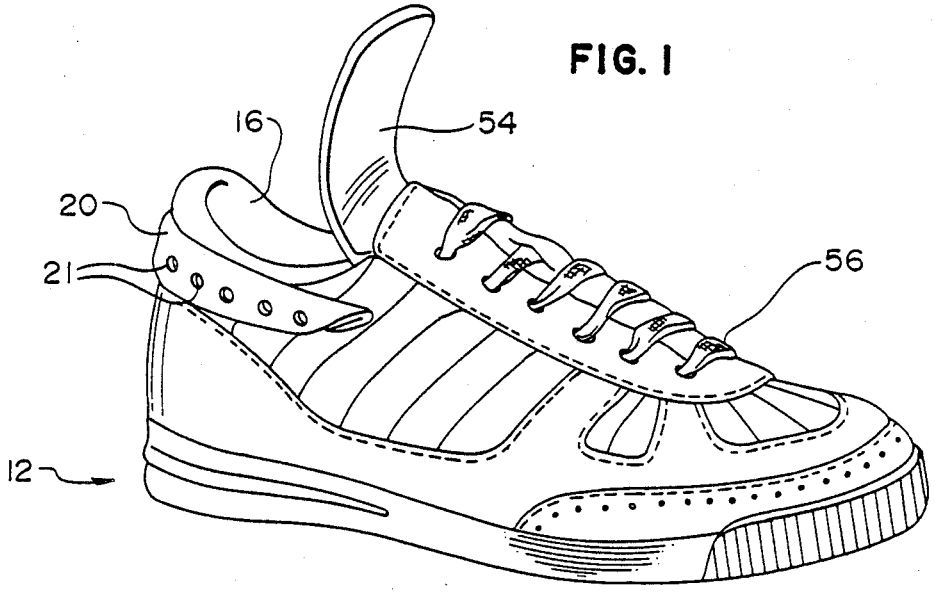
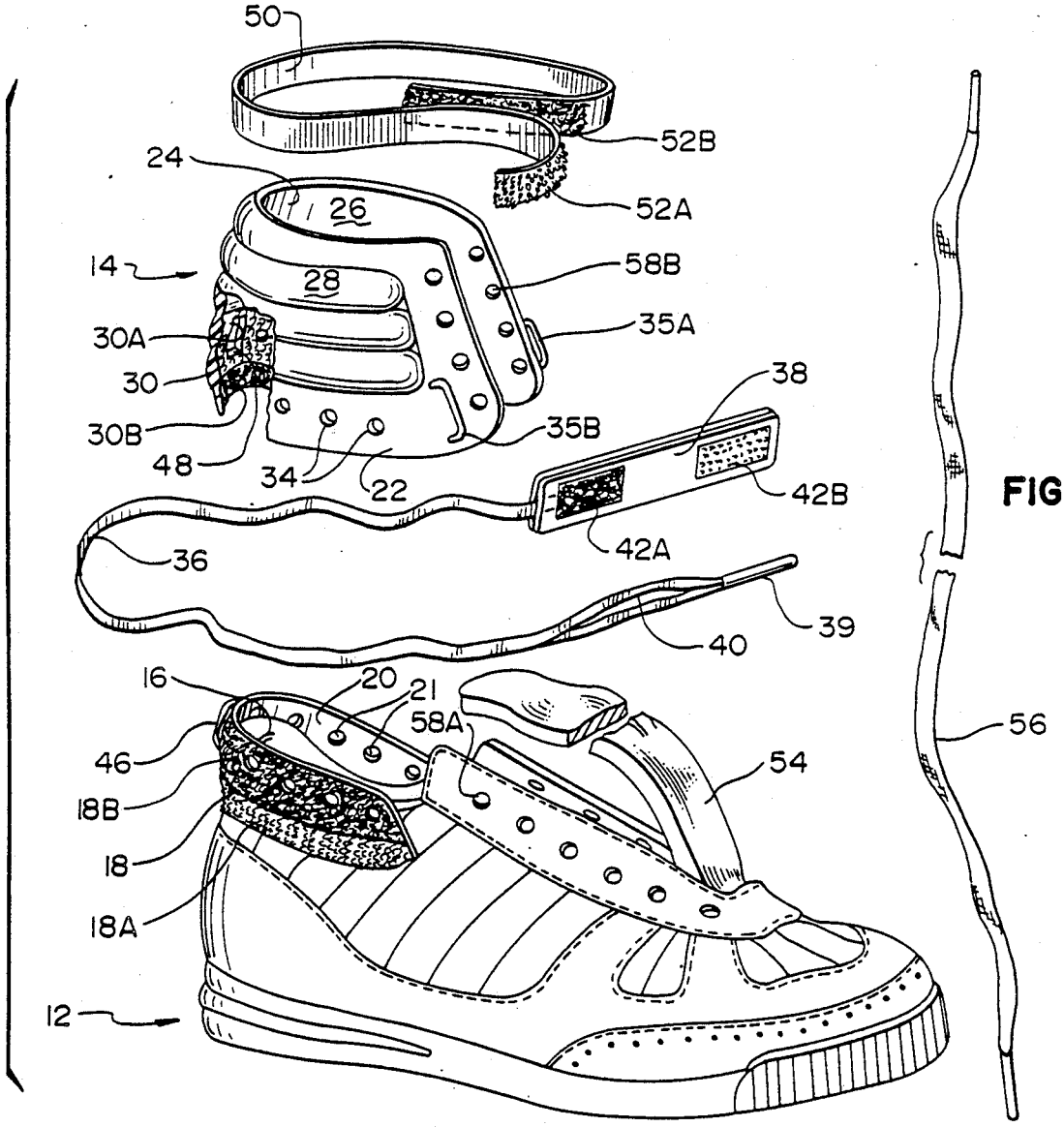
FIG. 2

CONVERTIBLE ATHLETIC SHOE HAVING LOW TOP AND HIGH TOP CONFIGURATIONS

FIELD OF THE INVENTION

This invention relates to convertible shoes, and in particular to athletic shoes that can be converted from a low-top shoe to a high-top shoe and vice versa.

BACKGROUND OF THE INVENTION

Athletic shoes have recently become fashionable for all endeavors. These shoes come in high-top and low-top styles. Many athletes prefer or require a high-top shoe for certain athletic activities and a low-top athletic shoe for other athletic activities. In addition to wearing athletic shoes for athletic events, athletes and others also simply wear these shoes for fashion or comfort. During these comfort or fashion wearing times, many wearers do not enjoy wearing high-top shoes as they are heavier and warmer than low-top shoes. In addition, many wearers are now very concerned with the style or fashion look of these shoes and require a fashionable shoe for both high-top and low-top styles.

In the past, in order for a wearer to get the benefits of both a high-top and a low-top shoe he or she was required to purchase both styles. This obviously increases the cost and requires the wearer to be fitted twice, once for each pair of shoes.

Prior attempts have been made to provide convertible low-top to high-top shoes. These attempts, however, did not provide shoes capable of standing up to the rigors of athletic wear nor did these shoes provide style and adequately conceal the fact that they were convertible. For example, U.S. Design Pat. No. 280,567 discloses a shoe that is comprised of a low-top shoe and an upper shoe adapter that is connected to the shoe by a visible zipper. This shoe does not appear to adequately provide the required needs of an athletic shoe. First, a wearer's lateral movements, such as hard cutting on a basketball court, may cause the zipper to buckle and break when the shoe is in the high-top configuration. Second, a metal zipper would not give the comfort needed for an athletic shoe. Third, a wearer's perspiration may cause a metal zipper to rust. Finally, when the shoe is in the low-top state, one half of the zipper appears to be left exposed to the wearer's ankle. In addition to being unsightly, this exposure is capable of cutting or injuring a wearer's ankle and could not be used safely for athletic wear.

Another attempt to provide a convertible shoe is disclosed in Crook, et al., U.S. Pat. No. 854,274. The non-athletic shoe described therein has a lower shoe portion and an upper adapter portion. The upper adapter portion has a number of studs around the lower edge thereof. Around the upper edge of the lower shoe portion are several socket pieces each having a slot enlarged at one end thereof. The adapter portion is secured to the lower shoe portion by placing the studs into the enlarged slots and sliding the studs and the upper adapter portion towards narrower ends of the slots. The adapter is further secured by two snaps each located on opposite sides of the shoe tongue. When the lower shoe portion is worn by itself, a separate strap having studs on one side is placed into the socket pieces to conceal the socket pieces and the convertibility of the shoe. This strap, however, does not do an adequate job of concealment, as it does not appear to conceal the snaps. In addition, this strap is not integrally attached to the lower shoe portion when the upper adapter is attached during high-top style wear. This strap can, therefore, be lost or misplaced and thus be unavailable for use when the lower shoe portion is to be worn alone. This shoe also does not appear to adequately provide the required features of an athletic shoe. Primarily, the shoe is designed to be an Oxford type shoe, not an athletic shoe. In addition, the studs and socket pieces do not provide the comfort needed for an athletic shoe and the socket pieces and the studs can rust due to a wearer's perspiration. Finally, the lateral movement of a wearer may cause one or several of the studs to slide out of the respective socket pieces thereby disengaging the upper adapter.

SUMMARY OF THE INVENTION

According to the present invention, a convertible shoe having a low-top and a high-top configuration is provided. The shoe comprises a lower shoe portion and an upper adapter portion having a lower shoe opening, means for securing the upper adapter portion to the lower shoe portion to place the shoe in the high-top configuration including a first fastener portion disposed on the lower shoe portion at least partially surrounding a foot opening thereof and a second fastener portion disposed on the upper adapter portion at least partially surrounding the lower shoe opening thereof and means carried by the lower shoe portion for concealing the first fastener portion when the upper adapter portion is not secured to the lower shoe portion during use in the low-top configuration.

Preferably, the concealing means includes a foldable strip capable of assuming folded and unfolded positions. When in the folded position, the strip is folded over itself to conceal the first fastener portion. Also preferably, the first and second fastener portions are of the hook and loop type. More specifically, the first fastener portion includes a first hook type fastener portion and a first loop type fastener portion and the second fastener portion includes a second hook type fastener portion and a second loop type fastener portion. When the convertible shoe is in the low-top configuration, the first hook fastener portion engages the first loop fastener portion to maintain the folded strip in the folded position to conceal the first fastener portion. When the convertible shoe is in the high-top configuration, the second loop fastener portion engages the first hook fastener portion and the second hook fastener portion engages the first loop fastener portion to secure the upper adapter portion to the lower shoe portion.

In addition, the upper adapter portion can be further secured to the lower shoe portion. Preferably, the foldable strip and the upper adapter portion each have a series of holes which are aligned with one another when the shoe is in the high-top configuration. A connecting means, such as a lacing, can be passed through these holes to further secure the upper adapter portion to the lower shoe portion. In this case, when the shoe lace is tightened over the upper adapter portion additional ankle support is provided.

The present invention therefore provides a convertible shoe without sacrificing fashion or any of the structural benefits normally provided by each individual shoe style. This convertible shoe in both the low-top and high-top configurations is stylish, can withstand the rigors of athletic wear and conceals the convertibility thereof. By providing two athletic shoes in one the present invention lessens the cost and storage space needed for a wearer to own both a high-top and a low-top shoe.

BRIEF DESCRIPTION OF THE DRAWINGS

The foregoing and other objects, features and advantages of the invention will be apparent from the following description thereof, as illustrated in the accompanying drawings in which like reference characters refer to the same parts throughout the different views:

FIG. 1 is a perspective view of the convertible shoe of the present invention in the low-top configuration;

FIG. 2 is an exploded perspective view of the shoe of FIG. 1 with portions removed for clarity;

DETAILED DESCRIPTION

Figure 3:
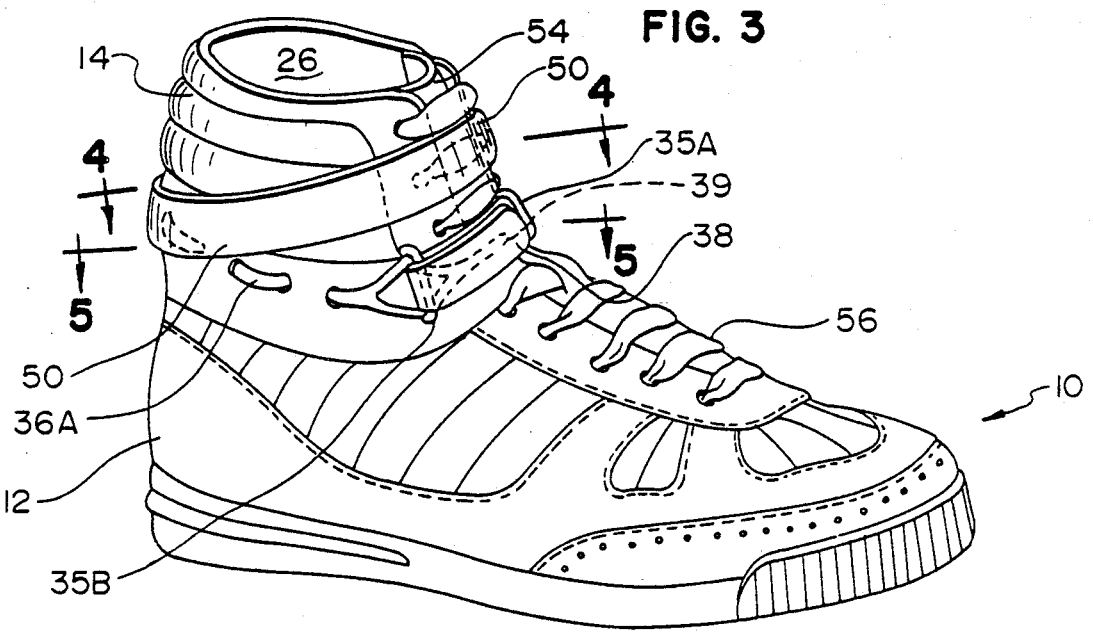
FIG. 3 is a perspective view of the convertible shoe in the high-top configuration.

As seen in FIGS. 1 and 3, a convertible shoe 10 is illustrated in low-top and high top configurations, respectively. As best seen in FIGS. 1 and 2, the main components of the shoe 10 include a lower shoe portion 12 and an upper adapter portion 14.

The lower shoe portion 12 may be a conventional low-top or ¾ height shoe. The lower shoe portion 12 has a foot opening 16. A first fastener portion 18 is carried by the lower shoe portion 12 via a foldable strip 20 which is capable of assuming a folded and an unfolded position. The foldable strip 20 is integrally secured to the lower shoe portion 12 by stitching or any other conventional means. The foldable strip 20 and the fastener portion 18 at least partially surround the foot opening 16.

As seen in FIG. 1, when the shoe is in the low-top configuration the fastener portion 18 may be concealed by positioning the foldable strip 20 in its folded position such that it is folded over itself. As noted in greater detail hereafter, the strip 20 is preferably releasably retained in the folded position. The portion of the foldable strip that is exposed when in the folded position is preferably made of the same material as the outer material of the lower shoe portion 12 so that it appears to simply be additional padding or simply shoe styling.

As seen in FIG. 2, when the foldable strip 20 is moved to the unfolded position, the fastener portion 18 is exposed. Fastener portion 18 preferably consists of adjacent strips of hook and loop portions of a hook and loop type fastener such as Velcro®. More particularly, a strip of loop type fastener portion 18A lies above a strip of hook type fastener portion 18B. Having both hook and loop type fastener portions 18A and 18B disposed on the foldable strip 20 allows the fastener portions 18A and 18B to engage and releasably retain the foldable strip 20 in the folded position. In the folded position, the foldable strip substantially conceals the fastener portions 18A and 18B. In a preferred embodiment, the foldable strip 20 also has a fist series of holes 21, as described more fully below, used to assist in securing the upper adapter portion 14 to the lower shoe portion 12.

As seen in FIGS. 2 and 3, the upper adapter portion 14 is preferably padded or otherwise constructed to provide ankle support. The outer material of the upper adapter portion 14 also preferably is composed of the same outer material as the lower shoe portion 12 to conceal the convertibility of the shoe 10. The upper adapter portion 14 has a lower shoe opening 22, a leg opening 24, a leg facing side 26 and an outer side 28. Partially surrounding the lower shoe opening 22 and disposed on the leg facing side 26 of the upper adapter portion 14 is a second fastener portion 30. As seen in FIG. 2, the fastener portion 30, like the fastener portion 18, preferably consists of adjacent strips of hook and loop portions of a hook and loop type fastener. More specifically, the fastener portion 30 includes a hook type fastener portion 30A disposed above a loop type fastener portion 30B.

In the preferred embodiment, the upper adapter portion 14 has a second series of holes 34 at least partially surrounding the lower shoe opening 22, and two loops 35A and 35B disposed at each end of the second series of holes 34 on the outer side 28 of the upper adapter portion.

The upper adapter portion 14 is easily attached to the lower shoe portion 12 to convert the shoe 10 from the low-top configuration to the high-top configuration. The foldable strip 20 is upwardly unfolded to its unfolded position to reveal the fastener portion 18 and to disengage the fastener portion 18A from the fastener portion 18B. The shoe opening 22 of the upper adapter is placed over the upwardly extending strip 20 on the lower shoe portion 12 and the fastener portions 30A and 30B are respectively aligned with the fastener portions 18A and 18B. Pressure is applied to the outer side 28 of the upper adapter portion 14 and fastener the portions 30A and 30B respectively engage fastener potions 18A and 18B to secure the upper adapter portion 14 to the lower shoe portion 12. In this manner, the body of the upper adapter portion 14 substantially conceals both fastener portions 18 and 30 from view when the shoe 10 is in the high-top configuration.

Figure 5:
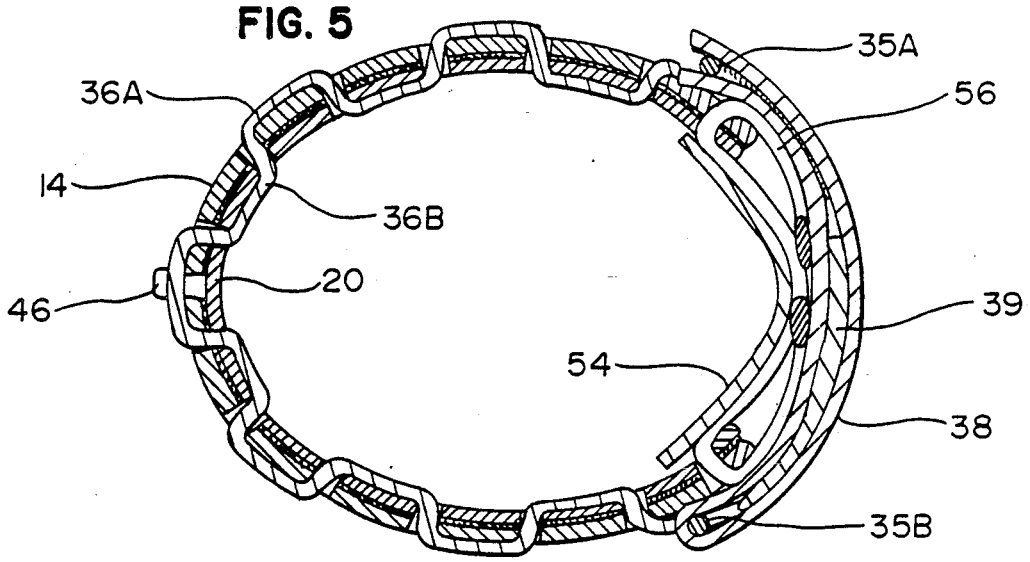
FIG. 5 is a cross-section taken generally along the line 5—5 of FIG. 3.

In the preferred embodiment, the upper adapter portion 14 is further secured to the lower shoe portion 12. When the upper adapter portion 14 is placed over and attached to the lower shoe portion 12, as described above, the first series of holes 21 of the foldable strip 20 and the second series of holes 34 of the upper adapter portion 14 are aligned. Means, preferably a lacing 36, is passed through the aligned first and second series of holes 21 and 34 to secure the upper adapter portion 14 to the lower shoe portion 12. As best seen in FIG. 2, the lacing 36 has a flexible bar 38 at one end, an aglet 39 at the other end and a hole 40 near the aglet 39. The flexible bar 38 has a matching pair of hook and loop type fastener portions 42A and 42B. The bar 38 is preferably made of a flexible material such as leather. As best seen in FIG. 5, the lacing 36, aglet 39 end first, is passed through the aligned first and second series of holes so that portions of the lacing 36A are disposed over the outer side 28 of the upper adapter portion 14 and portions of the lacing 36B lie inside the foldable strip 20 and are concealed from view during use. This lacing style mimics the lacing style of a moccasin and disguises the securing purpose of the lacing 36. To tighten the lacing, the flexible bar 38 is passed through the two loops 35A and 35B. A portion of the bar 38 is further passed through hole 40 in the lacing 36. The bar is folded back over itself, the loop 35B, a portion of the lacing 36 and the aglet 39 so that the fastener portion 42A engages the fastener portion 42B to secure and tighten the lacing 36. In addition to further securing the upper adapter portion 14 to the lower shoe portion 12, tightening the lacing 36 in conjunction with the body of the upper adapter portion 14 helps provide ankle support. The greater the tightening, the more ankle support if provided.

Figure 4:
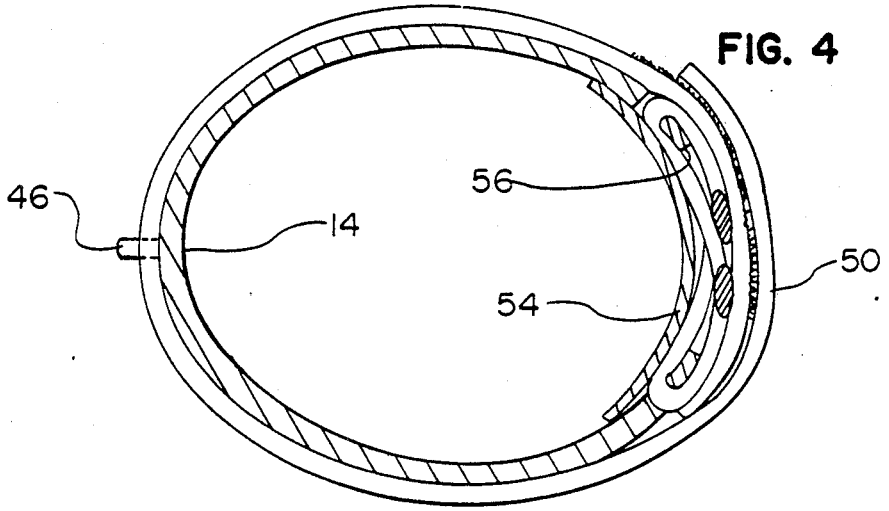
FIG. 4 is a cross-section taken generally along the line 4—4 of FIG. 3.

In the preferred embodiment, the convertible shoe 10 includes additional ankle support means when in the high-top configuration. As seen in FIGS. 2 and 4, a loop 46 is disposed on the foldable strip 20 near the middle of fastener portion 18 at the rear of the lower shoe portion 12. When the foldable strip 20 is upwardly extended from the shoe opening 16 the loop 46 is exposed and extends outwardly beyond the body of the upper adapter portion 14 through a hole 48 located in the back of the upper adapter portion 14 near the middle of the series of holes 34. A leather strap 50 having a matching pair of hook and loop type fastener portions 52A and 52B, respectively, located at each end is passed through the loop 46 and around the perimeter of the outer side 28 of upper adapter portion 14. The strap is then tightened and secured around the ankle over the upper adapter portion 14 by engaging the fastener portions 52A, 52B to augment ankle support.

It should be noted that the lower shoe portion 12 has a tongue 54 that is longer in length than those used in conventional low-top shoes so that it may reach the upper adapter portion 14 when the shoe is in the high-top configuration. To secure the shoe 10 to the wearers foot, the shoe also has lacing 56 that is longer than conventional low-top shoe lacing in order to be long enough to be laced through both the lacing holes 58A of the lower shoe portion 12 and the lacing holes 58B of the upper adapter portion 14.

In addition, the convertible shoe can be modified in accordance with further embodiments. For example, in one embodiment the fastener portions 18 and 30 may alternatively consist of only a hook type fastener portion or a loop type fastener portion. In this embodiment, the foldable strip 20 is releasably retained in the folded position by its own weight and/or the creasing of the foldable strip 20. Further, the fastener portions 18 and 30 may alternatively consist of a different type of fastening means that are comfortable and that will not injure the wearer. Also, the tongue 54 may include a loop (similar to loop 46), not shown, disposed near the top of and on the side of the tongue 54 facing the wearer's leg. When the shoe is worn in the low top configuration, the tongue 54 may be folded over itself to expose the loop. The loop may then be placed under the lacing 56 so that a portion of the lacing may be passed through the loop to keep the tongue 54 folded over itself to mimic the size of a tongue of a normal low top shoe.

While the above described embodiments are in accordance with the present invention, it is understood that the same is not limited thereto, but is susceptible of numerous changes as known to a person skilled in the art, and therefore, this invention is not limited to the details shown and described herein, but intended to cover all such changes and modifications as are obvious to one of ordinary skill in the art.

What is claimed is:

1. A convertible shoe having low-top and high-top configurations, comprising:

a lower shoe portion including a foot opening;

an upper adapter portion having a leg opening and a lower shoe opening;

means for securing the upper adapter portion to the lower shoe portion to place the convertible shoe in the high-top configuration including a first fastener portion disposed on the lower shoe portion at least partially surrounding the foot opening thereof and a second fastener portion disposed on the upper adapter portion at least partially surrounding the lower shoe opening thereof; and means carried externally by the lower shoe portion and integral therewith and at least partially surrounding the foot opening for concealing the first fastener portion when the upper adapter portion is separated from the lower shoe portion during use in the low-top configuration.

2. The convertible short of claim 1, wherein said means for concealing said first fastener portion includes a foldable strip capable of assuming folded and unfolded positions said first fastener portion being disposed on said foldable strip such that when said foldable strip is in said folded position said first fastener portion is concealed and such that when the foldable strip is in said unfolded position, said strip extends upwardly from said foot opening and said first fastener portion is exposed.

3. The convertible shoe of claim 2, wherein said first and second fastening portions are of the hook and loop type.

4. The convertible shoe of claim 3, wherein said first fastener portion includes a first hook fastener portion and a first loop fastener portion and said second fastener portion includes a second hook fastener portion and a second loop fastener portion wherein when said convertible shoe is in said low-top configuration said first hook fastener portion engages with said first loop fastener portion to maintain said foldable strip in said folded position and wherein when said convertible shoe is in said high-top configuration said first hook fastener portion engages said second loop fastener portion and said first loop fastener portion engages said second hook fastener portion to secure said upper adapter portion to said lower shoe portion.

5. The convertible shoe of claim 4 wherein said means capable of passing through said aligned first and second series of holes and said upper adapter portion jointly provide ankle support.

6. The convertible shoe of claim 2, wherein said upper adapter portion has a first series of holes and said foldable strip has a second series of holes aligned with said first series of holes when said convertible shoe is in said high-top configuration further including means capable of passing through said aligned first and second series of holes for securing said upper adapter portion to said lower shoe portion.

7. The convertible shoe of claim 6, wherein said means capable of passing through said first and second aligned series of holes and said upper adapter portion jointly provide ankle support.

8. The convertible shoe of claim 7, further including a strap surrounding the upper adapter portion and providing additional ankle support.

9. A convertible shoe having a low-top and a high-top configuration, comprising:

a lower shoe portion having a foot opening;

a first fastener portion;

means disposed externally on and integral with said lower shoe portion at least partially surrounding said foot opening for carrying said first fastener portion and having a folded position and an unfolded position, wherein the carrying means extends upwardly from said foot opening when in said unfolded position, and wherein said carrying means is folded over said first fastener portion when in said folded position and is releasably retained in said folded position;

an upper adapter portion having a lower shoe opening; and a second fastener portion disposed on said upper adapter portion at least partially surrounding said lower shoe opening thereof;

wherein said shoe is in said high-top configuration when said carrying means is in said unfolded position, the upper adapter is placed on said lower shoe portion, and said first and second fastener portions are engaged with each other, and wherein said shoe is in said low-top configuration when said upper adapter portion is separated from said lower shoe portion and said first and second fastener portions are disengaged from each other whereby said carrying means is capable of being placed in said folded position.

10. The convertible shoe of claim 9, wherein said first and second fastener portions include matching hook and loop type fastener portions.

11. The convertible shoe of claim 10, wherein said first fastener portion includes a first hook fastener portion and a first loop fastener portion and said second fastener portion includes a second hook fastener portion and a second loop fastener portion wherein when said carrying means is in said folded position said first loop fastener portion engages said first hook fastener portion to maintain said carrying means in said folded position and when said convertible shoe is in said high-top configuration said first hook fastener portion engages said second loop fastener portion and said first loop fastener portion engages said second hook fastener portion to secure said upper adapter portion to said lower shoe portion.

12. The convertible shoe of claim 11, wherein said carrying means substantially conceals said first fastener portion from view when said carrying means, is in said folded position and wherein said upper adapter further includes a leg facing side and an outer side whereby said second fastener portion is attached to said leg facing side of said upper adapter portion.

13. The convertible shoe of claim 12, wherein said further securing means comprises lacing.

14. The convertible shoe of claim 9, wherein said upper adapter has a first series of holes and said carrying means portion has a second series of holes aligned with said first series of holes when said convertible athletic shoe is in said high-top configuration and, said convertible shoe further including connecting means capable of passing through said aligned first and second series of holes to secure said upper adapter portion to said lower shoe portion.

15. The convertible shoe of claim 14, wherein said further securing means and said upper adapter shoe portion jointly provide ankle support.

16. The convertible shoe of claim 15, further including additional ankle support means.

17. A convertible shoe having low-top and high-top configurations, comprising:

a lower shoe portion including a foot opening;

an upper adapter portion having a leg opening and a lower shoe opening and a first series of holes;

means for securing the upper adapter portion to the lower shoe portion to place the convertible shoe in the high-top configuration including a first loop fastener portion and a first hook fastener portion both disposed on a foldable strip carried by and integral with the lower shoe portion at least partially surrounding the foot opening thereof and a second loop fastener portion and a second hook fastener portion both disposed on the upper adapter portion at least partially surrounding the lower shoe opening thereof;

the foldable strip having a second series of holes and capable of assuming folded and unfolded positions such that when said foldable strip is in said folded position and the upper adapter portion is separated from the lower shoe portion during use in the low-top configuration said first hook and loop fastener portions are concealed and such that when the foldable strip is in said unfolded position, said strip extends upwardly from said foot opening and said first hook and loop fastener portions are exposed;

wherein when said convertible shoe is in said low-top configuration said first hook fastener portion engages with said first loop fastener portion to maintain said folded strip in said folded position and wherein when said convertible shoe is in said high-top configuration said first hook fastener portion engages said second loop fastener portion and said first loop fastener portion engages said second hook fastener portion to secure said upper adapter portion to said lower shoe portion and said second series of holes is aligned with said first series of holes of said upper adapter portion; and means capable of passing through said aligned first and second series of holes for further securing said upper adapter portion to said lower shoe portion.

18. A convertible shoe having a low-top and a high-top configuration, comprising:

a lower shoe portion having a foot opening;

a first hook fastener portion and a first loop fastener portion;

means disposed on said lower shoe portion at least partially surrounding said foot opening for carrying said first hook and loop fastener portions and having a folded position and an unfolded position and a first series of holes, wherein the carrying means extends upwardly from said foot opening when in said unfolded position, and wherein in said folded position said carrying means is folded over and substantially conceals said first hook and loop fastener portions and said first loop fastener portion engages said first hook fastener portion to maintain said carrying means in said folded position;

an upper adapter portion having a lower shoe opening, a leg facing side and an outer side and a second series of holes;

a second hook fastener portion and a second loop fastener portion both disposed on said leg facing side of said upper adapter portion at least partially surrounding said lower shoe opening thereof;

wherein said shoe is in said high-top configuration when said carrying means is in said unfolded position, the upper adapter portion is placed on said lower shoe portion and said first hook fastener portion is engaged with said second loop fastener portion and said first loop fastener portion is engaged with said second hook fastener portion and said first series of holes is aligned with said second series of said upper adapter portion and wherein said shoe is in said low-top configuration when said upper adapter portion is separated from said lower shoe portion and said first hook and loop fastener portions are disengaged from said second hook and loop fastener portions whereby said carrying means is capable of being placed in said folded position; and means capable of passing through said aligned first and second series of holes for further securing said upper adapter portion to said lower shoe portion.

* * * * *